US011576506B2

(12) United States Patent
MacNeel et al.

(10) Patent No.: US 11,576,506 B2
(45) Date of Patent: Feb. 14, 2023

(54) MIRROR APPARATUS

(71) Applicant: MCS Industries, Inc., Easton, PA (US)

(72) Inventors: Joshua Ryan MacNeel, Rogers, AR (US); Ariane Ebba Boli, Delaware Water Gap, PA (US)

(73) Assignee: MCS INDUSTRIES, INC.

( * ) Notice: Subject to any disclaimer, the term of this patent is extended or adjusted under 35 U.S.C. 154(b) by 777 days.

(21) Appl. No.: 16/442,960

(22) Filed: Jun. 17, 2019

(65) Prior Publication Data

US 2019/0387903 A1 Dec. 26, 2019

Related U.S. Application Data

(60) Provisional application No. 62/687,866, filed on Jun. 21, 2018.

(51) Int. Cl.
*A47G 1/16* (2006.01)
*A47G 1/02* (2006.01)

(52) U.S. Cl.
CPC ..... *A47G 1/02* (2013.01); *A47G 1/166* (2013.01); *A47G 1/1613* (2013.01)

(58) Field of Classification Search
CPC ..... A47G 1/02; A47G 1/1613; A47G 1/166; E06B 9/02
USPC ..... 52/204.61, 204.66; 49/50–57; D25/52
See application file for complete search history.

(56) References Cited

U.S. PATENT DOCUMENTS 250,592 A * 12/1881 Smith ..... E06B 9/01 49/56
261,146 A * 7/1882 Fitch ..... E05F 11/00 292/202
273,265 A * 3/1883 Dotts ..... E05B 15/0093 292/230
1,284,399 A * 11/1918 McManus ..... E05B 65/0811 292/346
D61,673 S 11/1922 Aichberger
1,587,658 A * 6/1926 Laycock ..... E06B 3/50 160/91

(Continued)

FOREIGN PATENT DOCUMENTS

CA 2273679 A1 * 12/2000 ..... E06B 9/02

OTHER PUBLICATIONS

Shuttered Mirror, Flickr, Oct. 14, 2008, https://www.flickr.com/photos/thatissocute/2942223021/in/photolist-5tZEp8-2jsAffT-DjrQEY-2hV7nVK-6oecmb-Ki4rXT-SNrU5j-2mS1Erp-2mXxkBR-KJtoRd-2jncJ37-59jDrh-7VwKnK-nXmUKB-4XdXQU-8C1rwR-FKoxb9-4y6v97-2iM6xBU-AquHkr-LuhRZj-qW32UK-LbewnM-JN9sK8-2kWFZPj-wQJLYf-nY (Year: 2008).*

(Continued)

*Primary Examiner* — Cassandra Davis
(74) *Attorney, Agent, or Firm* — Belles Katz LLC

(57) ABSTRACT

A mirror apparatus that includes a mirror that is at least partially covered by a decorative door that is movable away from the mirror so that the mirror can be cleaned. The mirror apparatus includes a frame having an inner surface that defines a display opening. The mirror which is coupled to the frame may have a reflective front surface that is exposed within the display opening. The decorative door may be pivotably coupled to the frame between a closed state whereby the decorative door overlies the mirror and an open state whereby the decorative door does not overlie the mirror. In the open state, the mirror is completely exposed for cleaning. The mirror apparatus may also include a locking assembly for locking the decorative door in the closed state.

18 Claims, 10 Drawing Sheets

(56) References Cited

U.S. PATENT DOCUMENTS

| | | | | | |
|---|---|---|---|---|---|
| D77,738 | S | | 2/1929 | Bricker, Sr. et al. | |
| 1,959,745 | A | * | 5/1934 | Stout | A47G 1/06 40/757 |
| 1,971,923 | A | * | 8/1934 | Stern | A47G 1/06 40/768 |
| 2,050,322 | A | * | 8/1936 | Hills | E06B 9/01 16/374 |
| 2,650,124 | A | * | 8/1953 | Olson | E05C 3/041 292/240 |
| 2,896,989 | A | * | 7/1959 | Ehret | E05B 65/0817 292/108 |
| 2,924,862 | A | * | 2/1960 | Pellicore | E06B 9/01 292/228 |
| 3,183,547 | A | * | 5/1965 | Bury | E05D 15/00 49/67 |
| 4,249,345 | A | * | 2/1981 | Littleton | E06B 9/01 49/141 |
| 4,274,228 | A | * | 6/1981 | Kondracki | E05B 65/1033 292/60 |
| D265,933 | S | | 8/1982 | Simpson | |
| 4,369,828 | A | * | 1/1983 | Tatro | E06B 9/264 160/107 |
| 4,475,309 | A | * | 10/1984 | Porter | E06B 9/02 49/55 |
| 4,592,167 | A | * | 6/1986 | Andrawos | E06B 7/28 160/180 |
| 4,615,142 | A | * | 10/1986 | Reeves | E06B 9/02 49/55 |
| 4,624,072 | A | * | 11/1986 | Zilkha | E06B 9/02 49/55 |
| 4,630,396 | A | * | 12/1986 | Zvi | E06B 9/04 49/55 |
| 4,677,789 | A | * | 7/1987 | Merry | E06B 9/04 49/141 |
| D300,466 | S | | 3/1989 | Veranda | |
| 4,949,521 | A | | 8/1990 | Riegelman et al. | |
| 5,056,262 | A | * | 10/1991 | Schweiss | E05C 19/006 49/257 |
| 5,103,591 | A | * | 4/1992 | Szymanski | A62B 5/00 49/141 |
| 5,289,655 | A | * | 3/1994 | Marmora | E05B 65/1033 49/141 |
| 5,440,847 | A | | 8/1995 | Butler | |
| D409,394 | S | | 5/1999 | Zaidman | |
| D449,168 | S | | 10/2001 | Garrell | |
| D490,908 | S | | 6/2004 | Barnard | |
| D885,066 | S | | 5/2020 | MacNeel et al. | |
| 2021/0363151 | A1 | * | 11/2021 | Seo | H01L 51/0058 |

OTHER PUBLICATIONS

Le Miroir fenetre en 53 photos, Archzine, Jul. 11, 2017 https://web.archive.org/web/20170711063333/https://archzine.fr/meubles/miroir/miroir-fenetre/ (Year: 2017).*

Transform a Mirror with Shutters, Scavenger Chic, Nov. 7, 2016, https://scavengerchic.com/2016/11/07/transform-mirror-shutters/ (Year: 2016).*

Old Window and Shutters-Tutorial, ChalkBoard Blue, Jul. 20, 2012, http://www.chalkboardblue.com/2012/07/old-window-shutters-tutorial.html?showComment=1343942546118 (Year: 2012).*

Wayfair, *Faux Window Wood Wall Mirror* , https://www.wayfair.com/Laurel-Foundry-Modern-Farmhouse-Faux-Window-Wood-Wall-Mirror-LARK6837-L41-K~LARK6837.html?refid=GX112603340403-LARK6837&device=c&ptid=267451195181&network=s&targetid=pla-267451195181&channel=GooglePLA&gclid=CjwKCAjwgYPZBRBoEiwA2XeupUWxaJ3-EDrNwdNTWvRYBIeYrnq0Ax1C_KQW8gBJUj3cxYktISpeYBoCOnYQAvD_BwE: 2002-2019 Wayfair LLC, print date Jun. 17, 2019, pp. 1-7.

Overstock, *Somerset Window Pane Wall Mirror—Brown* , https://www.overstock.com/Home-Garden/Somerset-Window-Pane-Brown-Wood-Wall-Mirror/20112724/product.html: 2011 Overstock, print date Jun. 17, 2019, pp. 1-3.

Wayfair, *Highland Dunes Armanno Rustic Wall* , https://www.wayfair.com/Highland-Dunes-Armanno-Window-Shutter-Wall-Mirror-BF066550-L41-K~CYRG1858.html?refid=GX252787954711-CYRG1858&device=c&ptid=439821146061&network=g&targetid=aud-295866893899:pla-439821146061&channel=GooglePLA&gclid=CjwKCAjwgYPZBRBoEiwA2XeupWV80Akmnm6KxGF1rqmUSjiDpkeim3WDGMB05X7VEm4Y8cP162AGCxoC5YoQAvD_BwE: Wayfair, print date Jun. 17, 2019, p. 1.

Pinterest, *Discover ideas about Rustic Mantle Déco r—Window Pane Mirror Distressed Cream Sadie Arch Mirror* , https://www.pinterest.com/pin/582512533022360933/?lp=true: Pinterest, print date Jun. 17, 2019, pp. 1-4.

Better Homes & Gardens, *Patton Décor 24X24 Distressed White Arch Windowpane Mirror* , https://www.bhg.com/shop/pinnacle-patton-decor-24x40-distressed-white-arch-windowpane-mirror-p01e906225fd5e671cb0f56c5b2ccde54.html: Better Homes & Gardens and Pinnacle Decor, print date Jun. 17, 2019, pp. 1-2.

Google Express, *Kate and Laurel Boldmore Wood Windowpane Arch Mirror* (*Brown/White*) , https://express.google.com/u/0/product/17887208712271919887_4972240873378239624_10046?utm_source=google_shopping&utm_medium=tu_image&utm_content=eid-1sjeuxoeqt%2Ceid-wuakzuqbuq&gtim=CK2ytsjAwp61GBDytObfqsmDxDoYsJ_9XCIDVVNEKOCl--cFML5O&utm_campaign=10046&gclid=CjwKCAjw27jnBRBuEiwAdjQXDG_tKvx5tSJ-W9-TbbTLcMcp6qQ9fZydJvw4L8ZLAN14NdF3PPvEJxoCxdoQAvD_BwE: Google-Express, print date Jun. 17, 2019, pp. 1.

* cited by examiner

MIRROR APPARATUS

CROSS-REFERENCE TO RELATED APPLICATIONS

The present application claims priority to U.S. Provisional Patent Application Ser. No. 62/687,866, filed on Jun. 21, 2018, the entirety of which is incorporated herein by reference.

BACKGROUND

Mirrors are hung in many rooms throughout a home and office to enable a person to view themselves and also to create a desired aesthetic. Thus, mirrors have been developed with many different ornamental appearances so that a user can select the mirror that matches and enhances the aesthetic within the environment in which the mirror is to be hung. Typically, such ornamentation appears in a frame or border that surrounds the mirror itself. This is because blocking portions of the mirror with a decoration can make cleaning the mirror a frustrating and difficult task. Thus, a need exists for a mirror apparatus that has a desired aesthetic without affecting a user's ability to clean the mirror surface.

BRIEF SUMMARY

The present invention is directed to a mirror apparatus that includes a mirror that is at least partially covered by a decorative door that is movable away from the mirror so that the mirror can be cleaned. The mirror apparatus includes a frame having an inner surface that defines a display opening. The mirror which is coupled to the frame may have a reflective front surface that is exposed within the display opening. The decorative door may be pivotably coupled to the frame between a closed state whereby the decorative door overlies the mirror and an open state whereby the decorative door does not overlie the mirror. In the open state, the mirror is completely exposed for cleaning. The mirror apparatus may also include a locking assembly for locking the decorative door in the closed state In one aspect, the invention may be a mirror apparatus comprising: a frame having an inner surface that defines a display opening; a mirror coupled to the frame, the mirror comprising a reflective front surface that is exposed within the display opening; a decorative door pivotably coupled to the frame, the decorative door being pivotable between: (1) a closed state whereby the decorative door overlies a portion of the reflective front surface of the mirror, the decorative door comprising a plurality of openings through which the reflective front surface of the mirror remains exposed; and (2) an open state whereby the decorative door does not overlie any portion of the reflective front surface of the mirror; and a locking assembly configured to lock the decorative door in the closed state.

In another aspect, the invention may be a mirror apparatus comprising: a frame comprising a longitudinal axis, an inner surface that defines a display opening, a front surface, and a rear surface opposite the front surface; a first rabbet and a second rabbet formed into the rear surface of the frame; a mirror coupled to the frame within the first rabbet, the mirror comprising a reflective front surface that is exposed within the display opening; a backer panel coupled to the frame within the second rabbet; a first hanging element coupled to the rear surface of the frame on a first side of the longitudinal axis and a second hanging element coupled to the rear surface of the frame on a second side of the longitudinal axis, each of the first and second hanging elements comprising a plate portion that overlies the backer panel; a set of hinges coupled to the inner surface of the frame on the first side of the longitudinal axis; a decorative door pivotably coupled to the frame via the set of hinges, the decorative door being pivotable between: (1) a closed state whereby the decorative door overlies a portion of the reflective front surface of the mirror, the decorative door comprising a plurality of openings through which the reflective front surface of the mirror remains exposed; and (2) an open state whereby the decorative door does not overlie any portion of the reflective front surface of the mirror; and a locking assembly comprising: a lock plate coupled to the front surface of the frame on the second side of the longitudinal axis; and a latch pivotably coupled to a front surface of the decorative door; and wherein the locking assembly is adjustable between: (1) a locked state whereby the latch is oriented transverse to the longitudinal axis and the latch is located between the front surface of the frame and a portion of the lock plate to lock the decorative door in the closed state; and (2) an unlocked state whereby the latch is oriented parallel to the longitudinal axis and the decorative door can be freely pivoted between the closed and open states.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
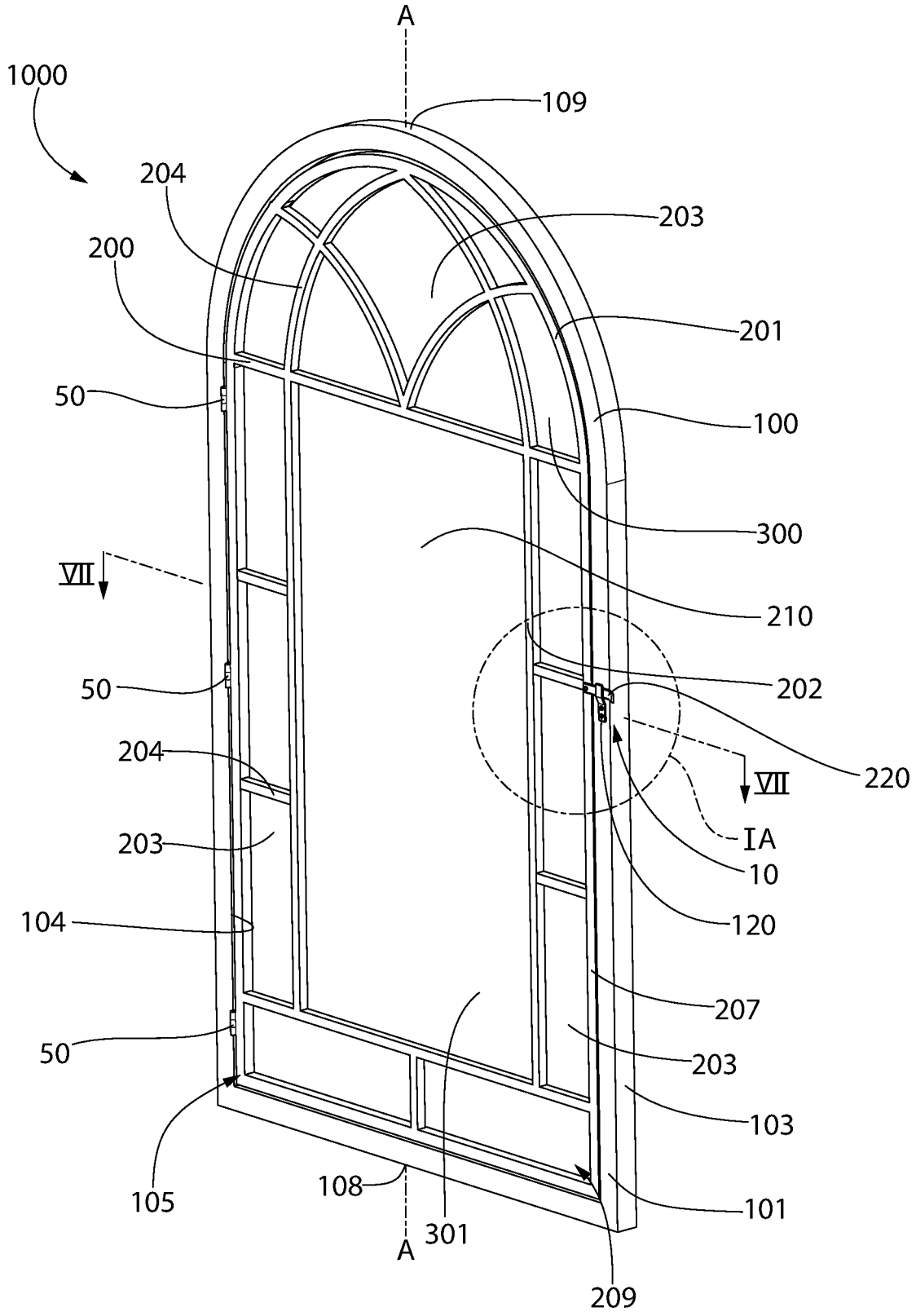
FIG. 1 is a front perspective view of a mirror apparatus having a frame and a decorative door in accordance with an embodiment of the present invention, whereby the decorative door is in a closed and locked state.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
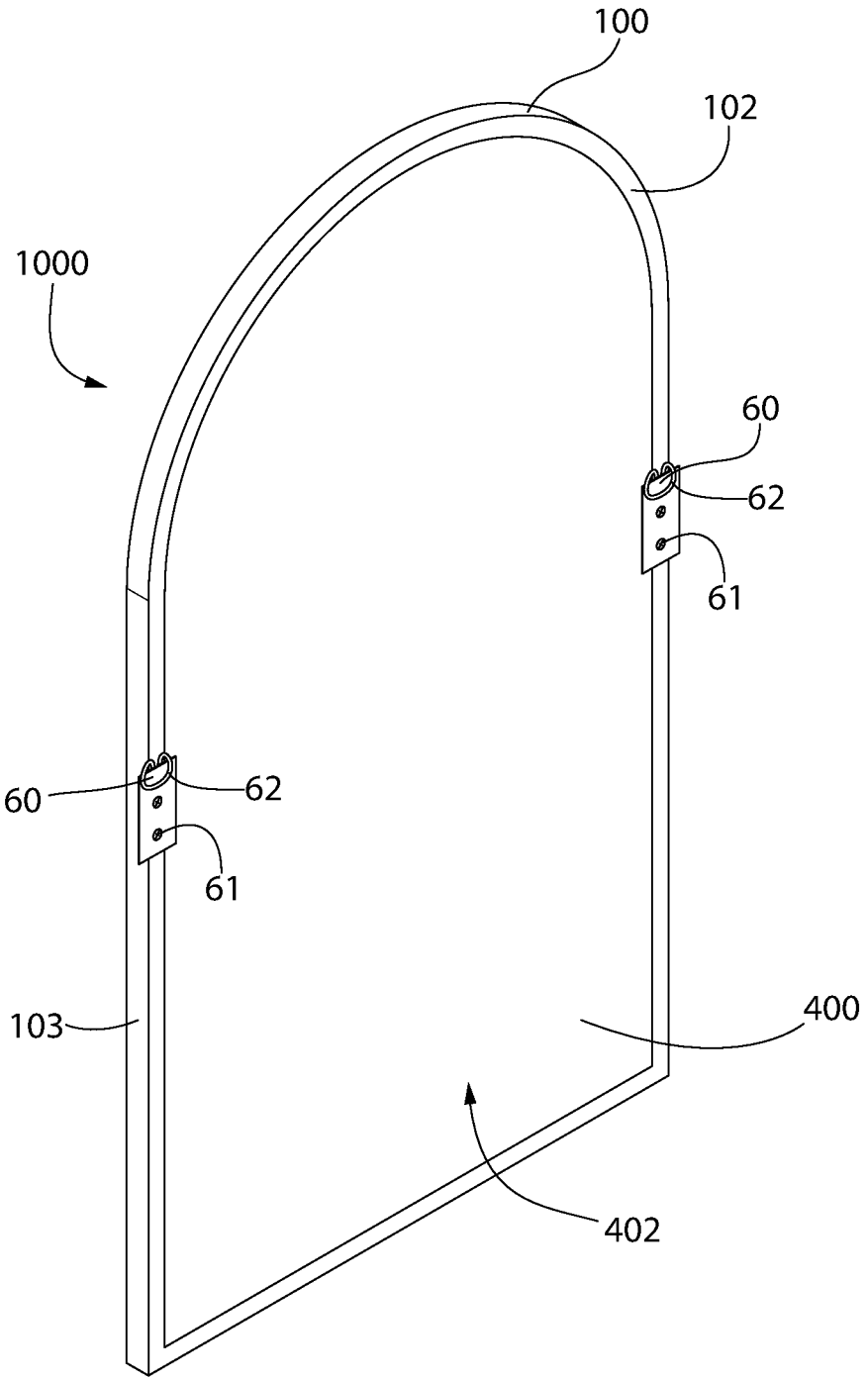
FIG. 2 is a rear view of the mirror apparatus of FIG. 1.
Figure 3:
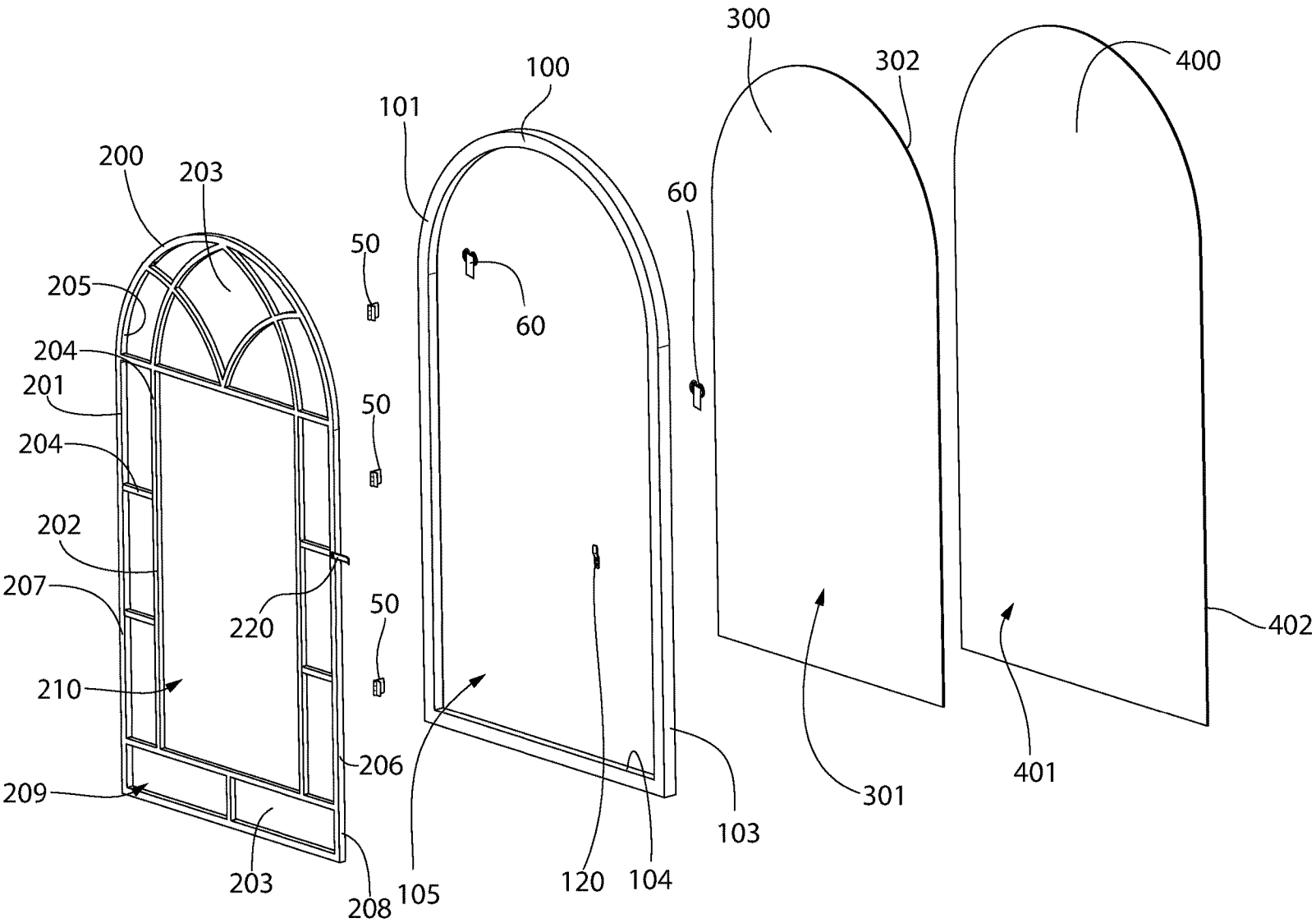
FIG. 3 is an exploded view of the mirror apparatus of FIG. 1.

Referring to FIGS. 1-3, a mirror apparatus 1000 is illustrated in accordance with an embodiment of the present invention. The mirror apparatus 1000 generally comprises a frame 100, a decorative door 200 coupled to the frame 100, a mirror 300 coupled to the frame 100, and a backer panel 400 coupled to the frame 100. The mirror apparatus 1000 extends from a bottom end 108 to a top end 109 along a longitudinal axis A-A. As will be better understood from the description below, the mirror 300 and the backer panel 400 are generally fixedly coupled to the frame 100 so that they are not movable relative to the frame 100 in the ordinary course of use. However, the decorative door 200 is coupled to the frame 100 via one or more hinges 50 so that the decorative door 200 can be altered between open and closed states. In the closed state, the decorative door 200 may be altered between a locked state and an unlocked state utilizing a locking assembly 10. The details of this functionality will be described in greater detail below with specific reference to FIGS. 4-6.

The frame 100 comprises a front surface 101, a rear surface 102 opposite the front surface 101, an outer surface 103, and an inner surface 104. The inner surface 104 of the frame 100 defines a display opening 105 through which the mirror 300 is displayed for viewing. In the exemplified embodiment, the frame 100 has an arch shape, although the invention is not to be so limited and in other embodiments the frame 100 may have a square, rectangular, triangular, circular, or other desired shape without detracting from the inventive concepts described herein. In some embodiments, the frame 100 may be formed from wood, although in other embodiments the frame 100 may be formed from other materials such as plastic, metal, or the like. The frame 100 may be formed from natural or synthetic wood such as engineered wood in some embodiments The mirror 300 is coupled to the frame 100 (the details of which will be described below with reference to FIG. 7). The mirror 300 comprises a front surface 301 that is visible from the front surface 101 of the frame 100 and an opposite rear surface 302. The front surface 301 of the mirror is the mirrored surface that includes a reflective material such that it reflects objects viewed therein. Thus, the front surface 301 may be described herein as a reflective front surface in some embodiments. The rear surface 302 of the mirror 300 may not be a reflective surface. The front surface 301 of the mirror is visible through the display opening 105 of the frame 100. The mirror 300 may have a shape that matches the shape of the frame 100. Thus, in the exemplified embodiment the mirror 300 is arch-shaped, although it can take on other shapes depending upon the shape of the frame 100.

The backer panel 400 is coupled to the frame 100 adjacent to the rear surface 302 of the mirror 300. The details of the manner in which the backer panel 400 is coupled to the frame 100 will be described below with reference to FIGS. 7 and 8. The backer panel 400 includes a front surface 401 and a rear surface 402 opposite the front surface 401. The backer panel 400 is coupled to the frame 100 so that the front surface 401 of the backer panel 400 is adjacent to the rear surface 302 of the mirror 300. When fully assembled, the rear surface 302 of the mirror 300 is covered and entirely hidden from view by the backer panel 400. The rear surface 402 of the backer panel 400 is exposed on the rear surface of the mirror apparatus 1000. The backer panel 400 may be coupled to the frame 100 so that the rear surface 402 of the backer panel 400 is flush with the rear surface 102 of the frame 100. The backer panel 400 may be formed from any desired materials, including without limitation chipboard, medium-density fiberboard (MDF), plastic, metal, wood, or the like. Moreover, in some embodiments it may be possible to omit the backer panel 400 from the mirror apparatus 1000. However, the backer panel 400 may be a desirable component to include in some embodiments because it can help to prevent cracking of the mirror 300 particularly during transit (e.g., from a manufacturing facility to a retail store to a consumer's home).

The decorative door 200 is also coupled to the frame 100 as noted above. In the exemplified embodiment, there are three hinges 50 that couple the decorative door 200 to the frame 100, although more or less than three hinges 50 can be used in other embodiments. In the exemplified embodiment, the hinges 50 are all coupled to the frame 100 on a first side of the longitudinal axis A-A. Thus, the decorative door 200 comprises a single, unitary, monolithic structure that covers or spans across the entirety of the mirror 300 when it is closed, although the decorative door 200 has a plurality of openings 203 (only some of which are labeled) through which the mirror 300 remains exposed even when the decorative door 200 overlies the mirror 300. In the exemplified embodiment, there are sixteen distinct openings 203, but in some embodiments there may be less or more. For example, in some embodiments there may be at least ten or at least twelve or at least fourteen distinct openings 203 formed into the decorative door 200.

The decorative door 200 may include a fretwork design that includes a plurality of interconnected strip-like bar members that collectively form a desired ornamental appearance. Although a specific fretwork is illustrated in the drawings, many modifications are possible. Thus, the fretwork can take on any desired appearance. However, in some embodiments it may be desirable to leave a large opening 210 in the center of the decorative door 200 to expose the front surface 301 of the mirror 300 at that location. Doing so leaves a large surface area of the mirror 300 unimpeded by the decorative door 200 to enhance the viewing experience. In the exemplified embodiment, the large opening 210 is rectangular in shape, although the large opening 210 is not to be limited in shape and may be circular, triangular, square, or any desired shape. In some embodiments, the large opening 210 may have an area of between 2.0 $ft^2$ and 2.5 $ft^2$, or more specifically between 2.25 $ft^2$ and 2.35 $ft^2$, so that a user can view a large portion of themselves unimpeded by any of the fretwork design. The remaining openings may be significantly smaller than the large opening 210. For example, in some embodiments a ratio of an area of the large opening 210 to an area of the next largest one of the openings 203 may be between 4:1 and 10:1, and more specifically between 6:1 and 8:1, and still more specifically between 6.5:1 and 7.5:1. In some embodiments the area of the large opening 210 may be greater than half of the surface area of the entire mirror 300. The large opening 210 is an unimpeded opening, meaning that no bars or strips of the fretwork design extend across the large opening 210. Rather, the large opening 210 is a singular opening bounded by one or more strip-like bar members of the fretwork design as described herein and shown in the drawings.

The decorative door 200 includes a perimeter portion 201 and an ornamental portion 202 that is surrounded by the perimeter portion 201. The perimeter portion 201 forms a closed geometric shape that corresponds to the shape of the frame 100 of the mirror apparatus 1000. Thus, in the exemplified embodiment the perimeter portion 201 has an arch shape that matches the arch shape of the frame 100. The perimeter portion 201 is formed by a single bar or strip that is curved into a desired shape, which is an arch shape in the exemplified embodiment. Of course, the perimeter portion 210 could be formed by multiple bars or strips that are coupled together (such as by welding, adhesion, mechanical fasteners or means, or the like) in other embodiments. The perimeter portion 201 of the decorative door 200 comprises an inner surface 205, an outer surface 206, a front surface 207, and a rear surface 208. The front surface 207 faces away from the mirror 300 and is flush with the front surface 101 of the frame 100 when the decorative door 200 is in the closed state. The rear surface 208 faces the mirror 300 when the decorative door 200 is in the closed state. The inner surface 205 of the perimeter portion 201 defines or surrounds an opening 209 and the ornamental portion 202 is located within and extends partially or entirely across the opening 209.

When in the closed state as shown in FIG. 1, the outer surface 206 of the perimeter portion 201 of the decorative door 200 is adjacent to and faces the inner surface 104 of the frame 100 with minimal (1-3 mm) spacing between the decorative door 200 and the frame 100. This minimal spacing is needed to allow the decorative door 200 to be moved between the open and closed states. However, in other embodiments there may be no gap between the outer surface 206 of the perimeter portion 201 of the decorative door 200 and the inner surface 104 of the frame 100 to create a friction fit between the decorative door 200 and the frame 100. In any case, in the exemplified embodiment the decorative door 200 remains as a singular door that is adjacent to the inner surface 104 of the frame 100 along the entirety thereof. Thus, in the exemplified embodiment, there are not multiple decorative doors, but rather there is just one single door. An entirety of the outer surface 206 of the perimeter portion 201 is directly adjacent to an entirety of the inner surface 104 of the frame 100 with no intervening structures. Thus, there is nothing located between the outer surface 206 of the perimeter portion 201 and the inner surface 104 of the frame 100 except for possibly an air gap as noted above.

The ornamental portion 202 of the decorative door 200 includes a plurality of strips (or strip-like members) 204 that extend within the perimeter portion 201. The strips 204 are either coupled to one another and/or to the inner surface 205 of the perimeter portion 201. In embodiments whereby the decorative door 200 is formed entirely from metal (such as aluminum or aluminum alloys or the like), the strips 204 may be coupled to one another and/or to the perimeter portion 201 via welding or similar techniques. The ornamental portion 202 can take on different ornamentations than that which is depicted in the drawings. In the exemplified embodiment, the plurality of strips 204 includes a combination of horizontally oriented strips, vertically oriented strips, linear strips, and arcuate strips that make up the fretwork design. The positioning, length, and other features of the strips 204 may be modified to create a different fretwork design that still falls within the confines of the invention described herein. Thus, to reiterate, the invention is not limited to the particular fretwork design and the particular configuration of the strips 204 of the ornamental portion 202 of the decorative door 200 as shown in the drawings in all embodiments unless specifically claimed as such.

In the exemplified embodiment, the perimeter portion 201 is wider than the strips 204 of the ornamental portion 202. For example, the perimeter portion 201 may have a width (measured between the inner and outer surfaces 205, 206) of between approximately 0.45 inches and 0.55 inches and the strips 204 that form the ornamental portion 202 may have a width of between approximately 0.30 inches and 0.35 inches. Of course, the invention is not to be limited by these dimensions in all embodiments. In the exemplified embodiment, the decorative door 200 may be formed from metal, although alternative materials may be used including plastic, wood (natural or engineered/synthetic), and the like. In the exemplified embodiment, the decorative door 200 is formed entirely from metal.

In the exemplified embodiment, there are two hanging elements 60 coupled to the rear surface 102 of the frame 100 to facilitate hanging of the mirror apparatus 1000 from a vertical surface such as a wall. In the exemplified embodiment, the hanging elements 60 are D-ring hangers comprising a plate portion 61 and a D-ring 62. Of course, D-ring hangers are merely used in the exemplified embodiment and other types of hanging elements can be used in other embodiments, including sawtooth hangers, plates, brackets, screw eyes, wires, or the like. In the exemplified embodiment, the two hanging elements 60 are positioned on different sides of the longitudinal axis A-A to help with hanging the mirror apparatus 1000 in a level manner. Of course, more or less hanging elements 60 can be used in other embodiments. For example, a single hanging element 60 may be coupled to the rear surface 102 of the frame 100 along the top of the frame 100 and/or the bottom of the frame 100 in other embodiments. Many variations regarding the hanging hardware for the mirror apparatus 1000 are possible within the scope of the invention described herein as should be appreciated by persons skilled in the art.

In the exemplified embodiment, the hanging elements 60 are secured to the rear surface 102 of the frame 100. This may be achieved using fasteners such as screws, nails, rivets, or the like. As shown in FIG. 2, the hanging elements 60 are coupled to the rear surface 102 of the frame 100 and positioned so that a portion of the plate portion 61 of the hanging elements 60 extends over (i.e., overlies) the backer panel 400. One benefit of this is that it enables the hanging elements 60 to have a secondary function, which is to retain the backer panel 400 (and also the mirror 300) in position. Specifically, the backer panel 400 cannot be separated from the frame 100 because the plate portion 61 overlies the backer panel 400 and prevents from being removed via the rear surface 102 of the frame 100. Although the backer panel 400 is likely also coupled to the frame 100 using other means (hardware, adhesive, or the like), using the hanging elements 60 in this way provides an additional mechanism to ensure that the backer panel 400 remains coupled to the frame 100.

Figure 4:
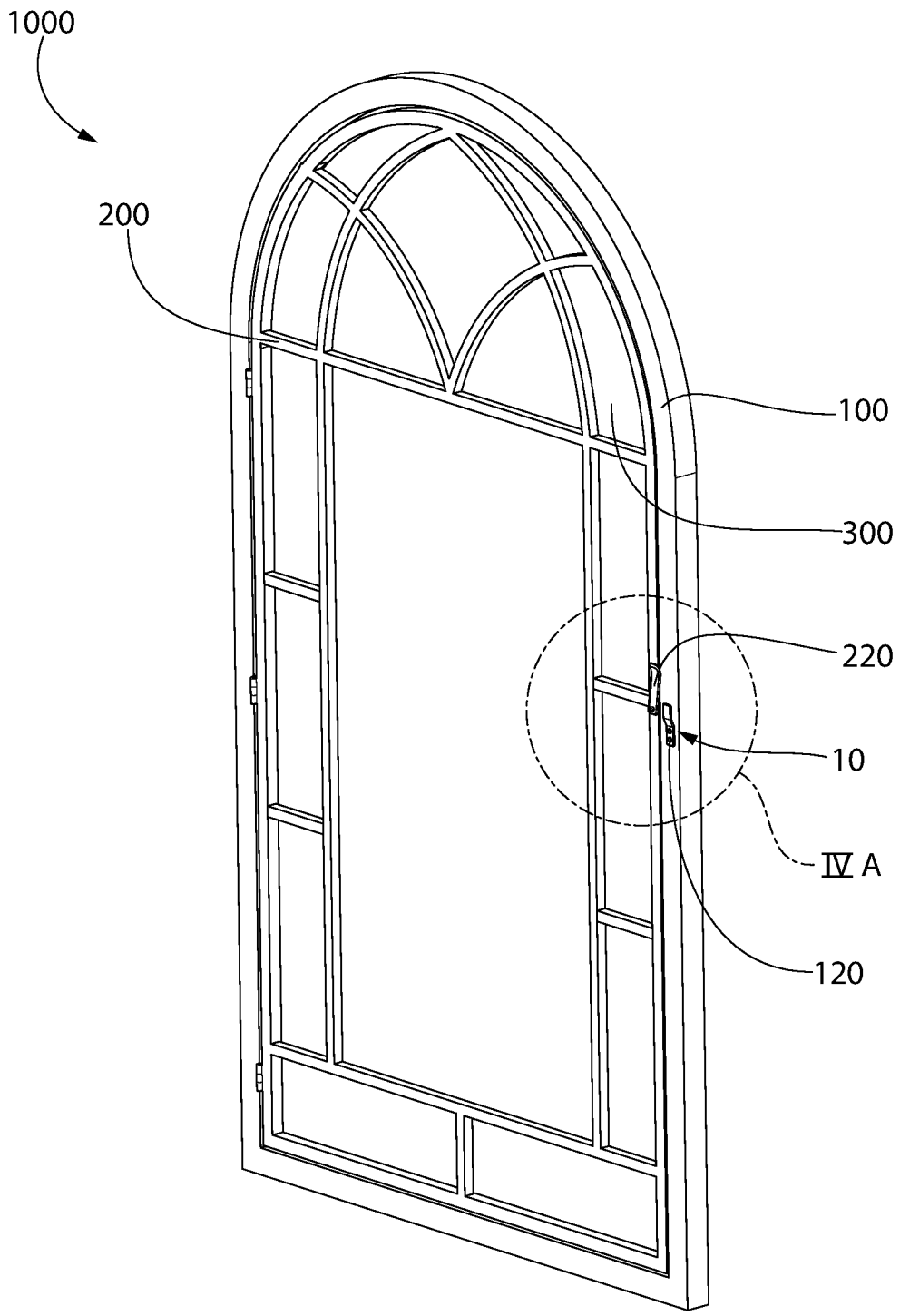
FIG. 4 is a front perspective view of the mirror apparatus of FIG. 1 with the decorative door in an unlocked and closed state.
Figure 5:
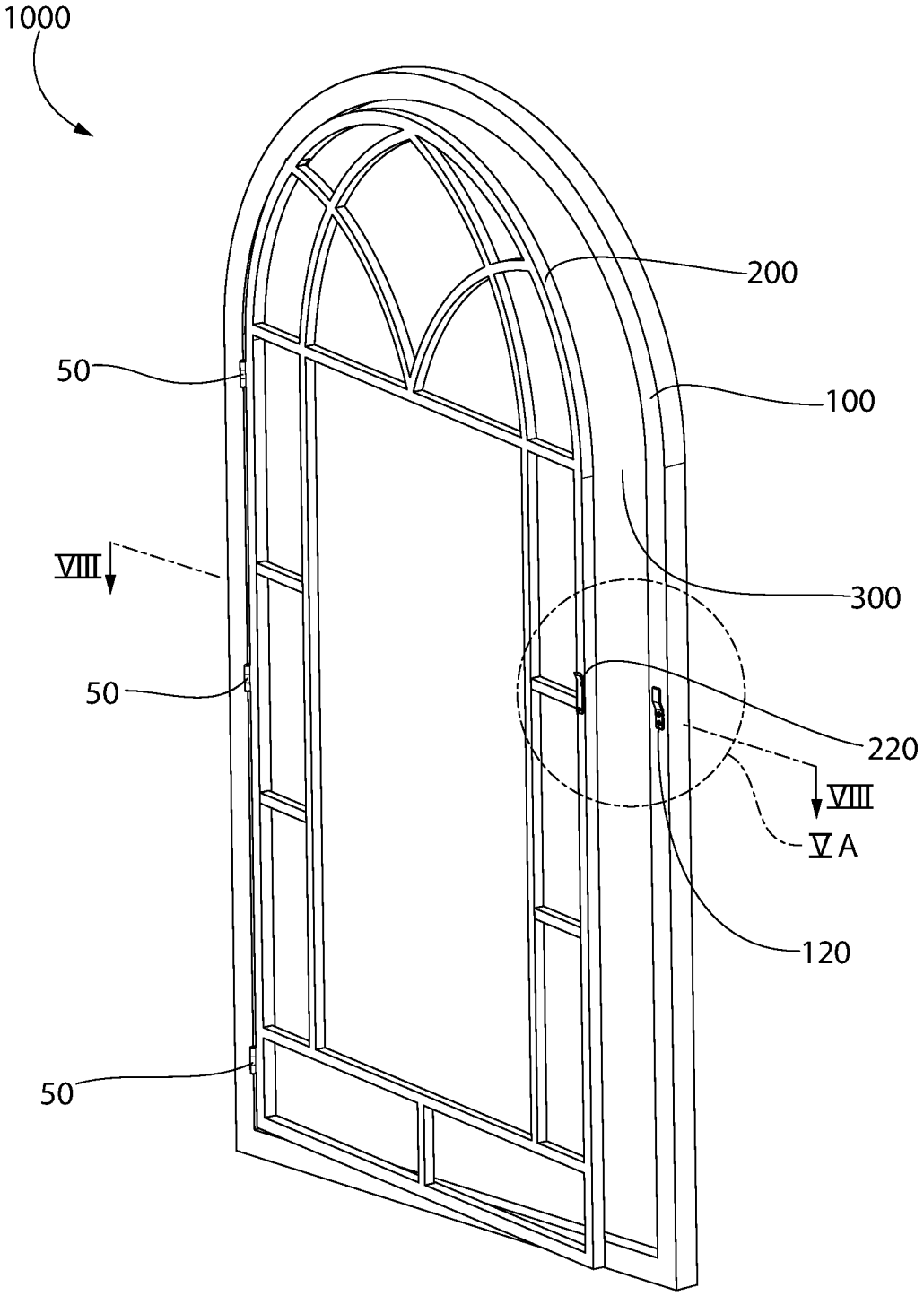
FIG. 5 is a front perspective view of the mirror apparatus of FIG. 1 with the decorative door in an unlocked and partially open state.
Figure 6:
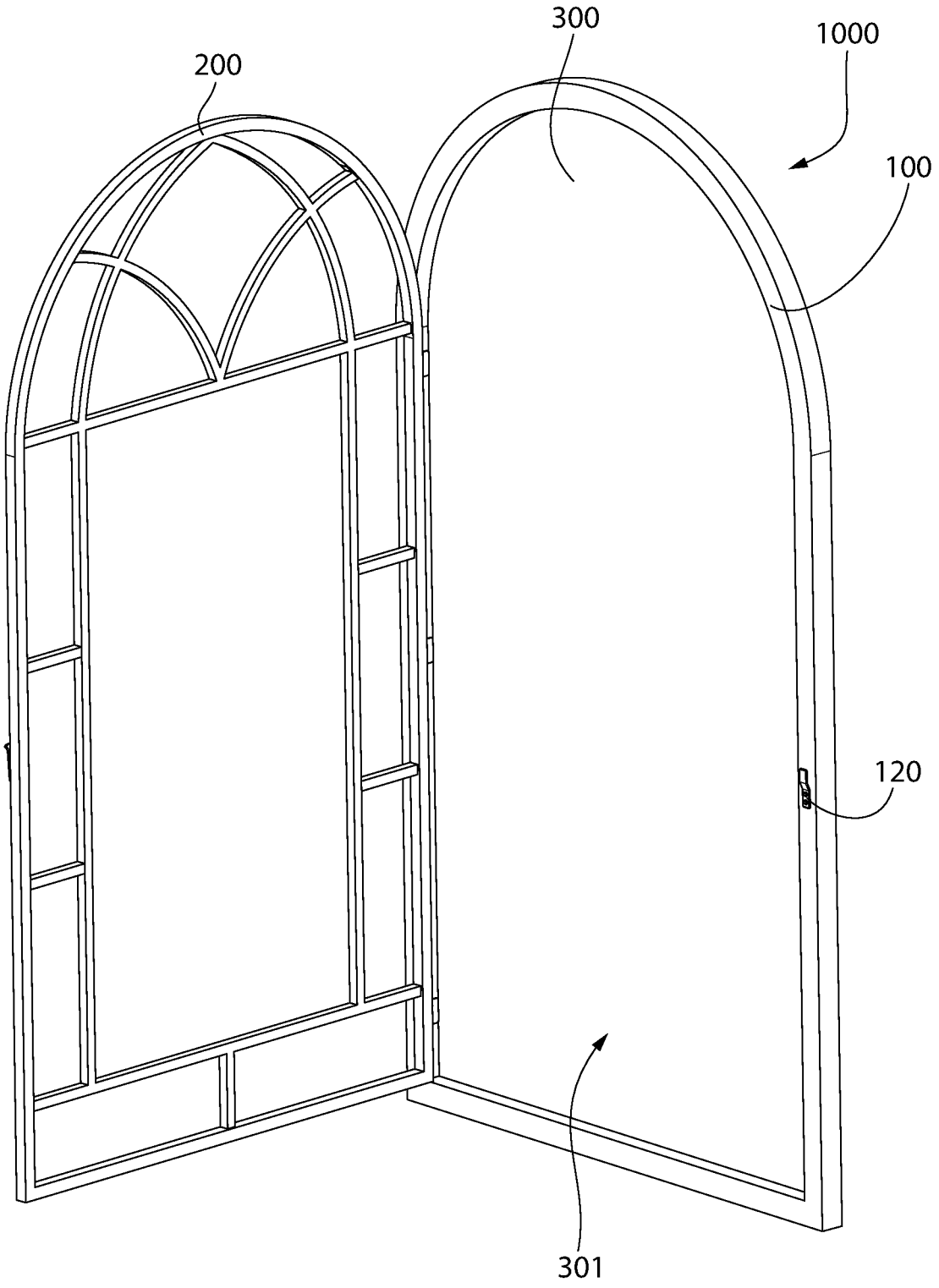
FIG. 6 is front perspective view of the mirror apparatus of FIG. 1 with the decorative door in an open state.

The decorative door 200 may be altered into the following states relative to the frame 100: (1) a closed and locked state, as shown in FIG. 1; (2) a closed and unlocked state, as shown in FIG. 4; (3) a partially open and unlocked state, as shown in FIG. 5; and (4) a fully open and unlocked state, as shown in FIG. 6, although the decorative door 200 can open past the point illustrated in FIG. 6 in some embodiments such that it may be configured to rotate 180° relative to the frame 100.

Figure 1A:
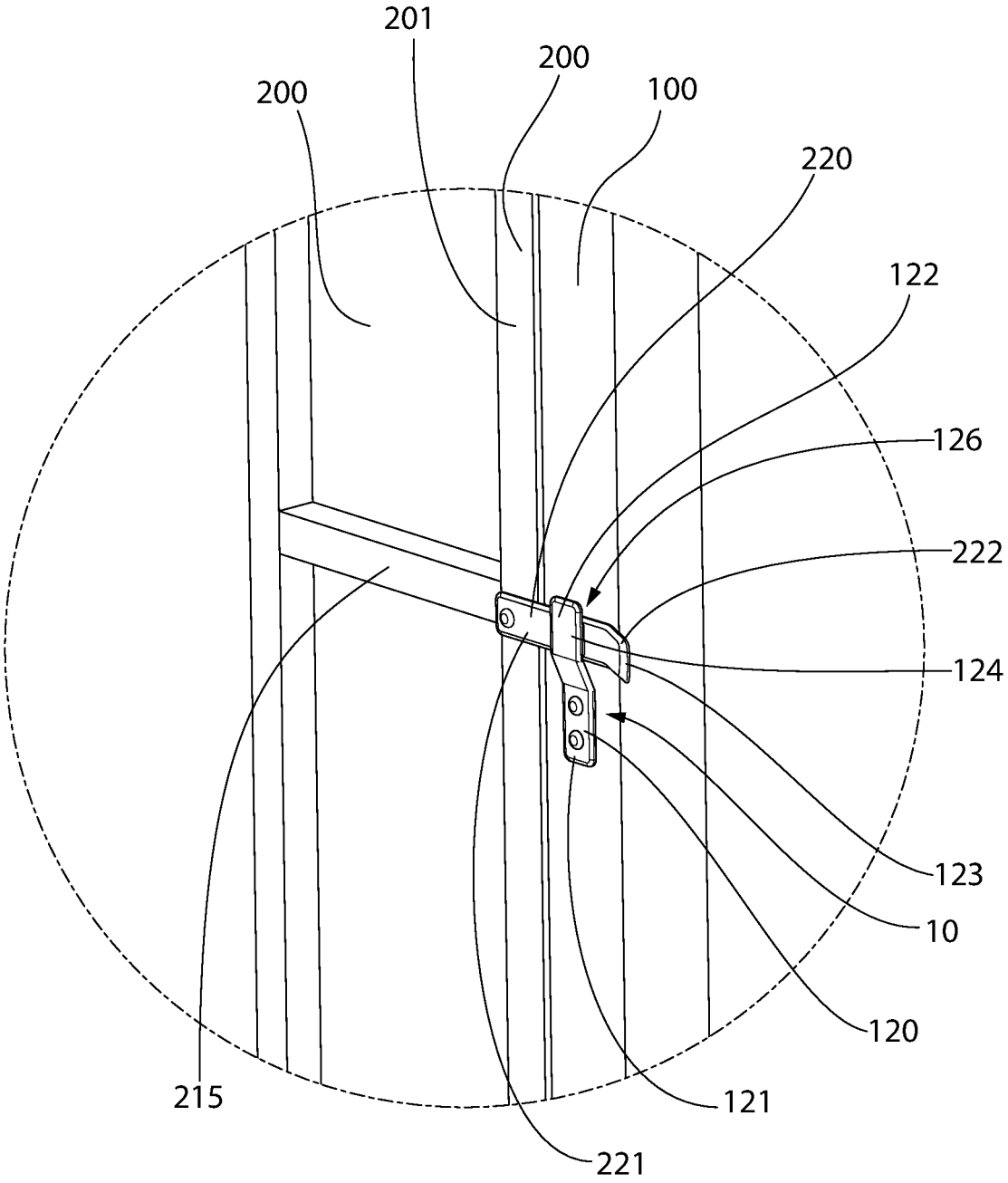
FIG. 1A is a close-up view of area IA of FIG. 1.

Referring to FIGS. 1 and 1A, the mirror apparatus 1000 includes a locking assembly 10 that facilitates the locking and unlocking of the decorative door 200 relative to the frame 100. In the exemplified embodiment, the locking assembly 10 comprises a latch 220 that is coupled to the front surface 207 of the perimeter portion 201 of the decorative door 200 and a lock plate 120 that is coupled to the front surface 101 of the frame 100 of the mirror apparatus 1000. The latch 220 is coupled to the decorative door 200 in such a manner that it can rotate relative to the perimeter portion 201 about a rotational axis. Specifically, the latch 220 may be coupled to the perimeter portion 201 with a rivet or other hardware the allows for this rotation. In the exemplified embodiment, the latch 220 is configured for 360° rotation relative to the decorative door 200. However, in other embodiments the latch 220 may be configured for 90° or 180° rotation without affecting its functionality.

Although the locking assembly 10 comprises the latch 220 and the lock plate 120 in the exemplified embodiment, the invention is not to be so limited in all embodiments. The locking assembly 10 can take on other forms in other embodiments, including without limitation, being a hook/hook holder, magnets, hook-and-loop, lock and key, door chain, traditional knob with lock and/or bolt, a sliding latch (rather than a rotating latch as shown in the exemplified embodiment), interference fit, or the like. Thus, the locking assembly 10 is not to be limited to the latch 220 and the lock plate 120 unless so claimed, although the latch 220 and lock plate 120 configuration has been found to be desirable from a durability and aesthetic standpoint. For example without limitation, in one embodiment the decorative door 200 and the frame 100 may comprise corresponding hook-and-loop fasteners (with the hook fasteners on one of the decorative door 200 and the frame 100 and the loop fasteners on the other one of the decorative door 200 and the frame 100) that mate and interact with the decorative door 200 in the closed state to hold/lock the decorative door 200 in the locked state.

In the exemplified embodiment, the latch 220 comprises a first portion 221 and a second portion 222 extending from the first portion 221 to a distal or terminal or free end 223 of the latch 220. The second portion 222 is oriented obliquely to the first portion 221. Thus, the second portion 222 forms a gripping tab that is easy to grip and maneuver by a user so that the user can readily alter the latch 220 between the locked and unlocked states, as described further herein below.

As shown in the figures, in the exemplified embodiment the latch 220 is aligned with one of the horizontal strips 215 of the plurality of strips 204. Thus, the latch 220 is aligned with the horizontal strip 215 so that a transverse axis that is transverse to the longitudinal axis A-A of the mirror apparatus 1000 intersects the horizontal strip 215 and the latch 220. This serves to make the latch 220 inconspicuous because it blends in with the horizontal strip 215. This creates a desirable aesthetic in that when the mirror apparatus 1000 is hung from a wall, a user's eyes are not drawn to the latch 220 because it somewhat blends in with the fretwork design of the decorative door 200. Thus, the opening/closing/locking functionality of the mirror apparatus 1000 is not made immediately clear to a viewer of the mirror apparatus 1000.

The lock plate 120 is fixedly coupled to the front surface 101 of the frame 100 using any desired fastener or hardware, such as rivets, screws, nails, bolts, or the like. The lock plate 120 comprises a mounting portion 121 that is coupled directly to the frame 100 and a locking portion 122 that is spaced apart from the front surface 101 of the frame 100. The mounting portion 121 may comprise openings through which fasteners can extend into the frame 200 to couple the lock plate 120 to the frame 100. The locking portion 122 of the lock plate 120 comprises a first portion 123 that extends obliquely from the mounting portion 121 in a direction away from the front surface 101 of the frame 100 and a second portion 124 that extends obliquely from the first portion 123 and parallel to the mounting portion 121.

Thus, the locking portion 122 of the lock plate 120 is spaced apart from the front surface 101 of the frame 100 by a gap 126. The gap 126 has a depth measured from the front surface 101 of the frame 100 to the locking portion 122 of the lock plate 120 that is greater than a thickness of the latch 220. Thus, the latch 220 can fit within the gap 126 to place the decorative door 200 into the locked state. Due to their orientations, the second portion 124 of the locking portion 122 of the lock plate 120 is located a constant distance away from the front surface 101 of the frame 100, while a distance between the first portion 123 of the locking portion 122 of the lock plate 120 and the front surface 101 of the frame 100 decreases with distance away from the second portion 124 and towards the mounting portion 121. This allows for the latch 220 to easily enter into the gap 126, but as the latch 220 moves downwardly within the gap 126 and the depth of the gap 126 decreases, the latch 220 becomes tightly held in position between the first portion 123 of the locking portion 122 of the lock plate 120 and the front surface 101 of the frame 100. As a result, some force is required by the user to remove the latch 220 from the gap 126 to overcome the pressure being applied on the latch 220 by the first portion 223 of the locking portion 222 of the lock plate 220 and the front surface 101 of the frame 100.

FIGS. 1 and 1A illustrate the decorative door 200 in the closed and locked state. In this state, the latch 220 is oriented horizontally and nests within the gap 126. With the latch 220 located in the gap 126, the decorative door 200 is prevented from opening because any attempt to open the decorative door 200 will cause the latch 220 to contact the locking portion 122 of the lock plate 120, thereby preventing the opening of the decorative door 200.

Figure 4A:
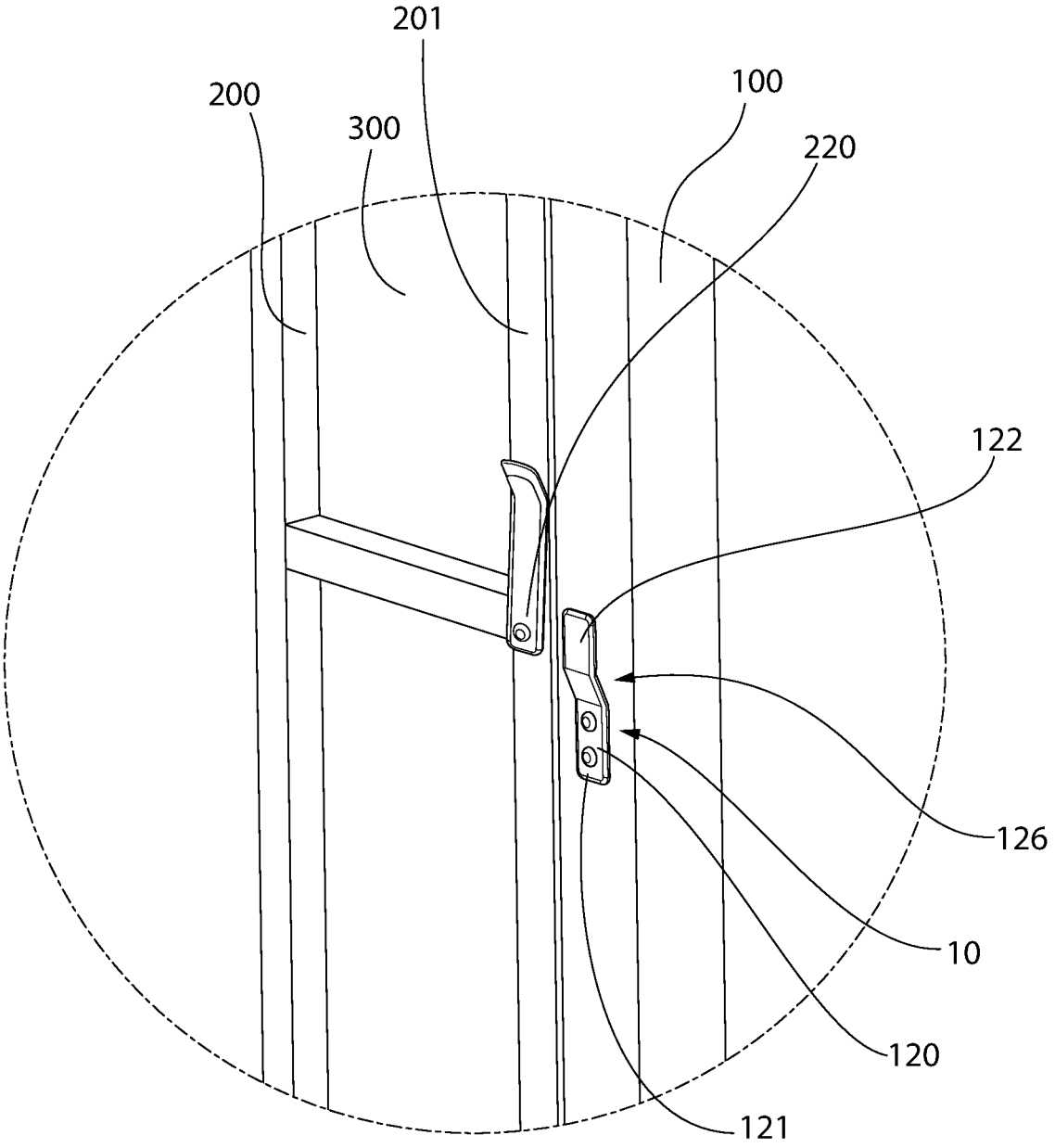
FIG. 4A is a close-up view of area IVA of FIG. 4.

Referring to FIGS. 4 and 4A, the mirror apparatus 1000 is illustrated with the decorative door 200 in the closed and unlocked state. To alter the decorative door 200 from the locked state to the unlocked state, the latch 220 is rotated relative to the perimeter portion 201 of the decorative door 200 until the latch 220 is entirely removed from the gap 126. As a result, the locking portion 122 of the lock plate 120 no longer impedes the decorative door 200 from being altered from the closed state to the open state. The latch 220 could be rotated 90° as shown in FIGS. 4 and 4A, or the latch 220 could be rotated further so long as the latch 220 is rotated a sufficient amount so that no portion of the latch 220 is located within the gap 126.

Figure 5A:
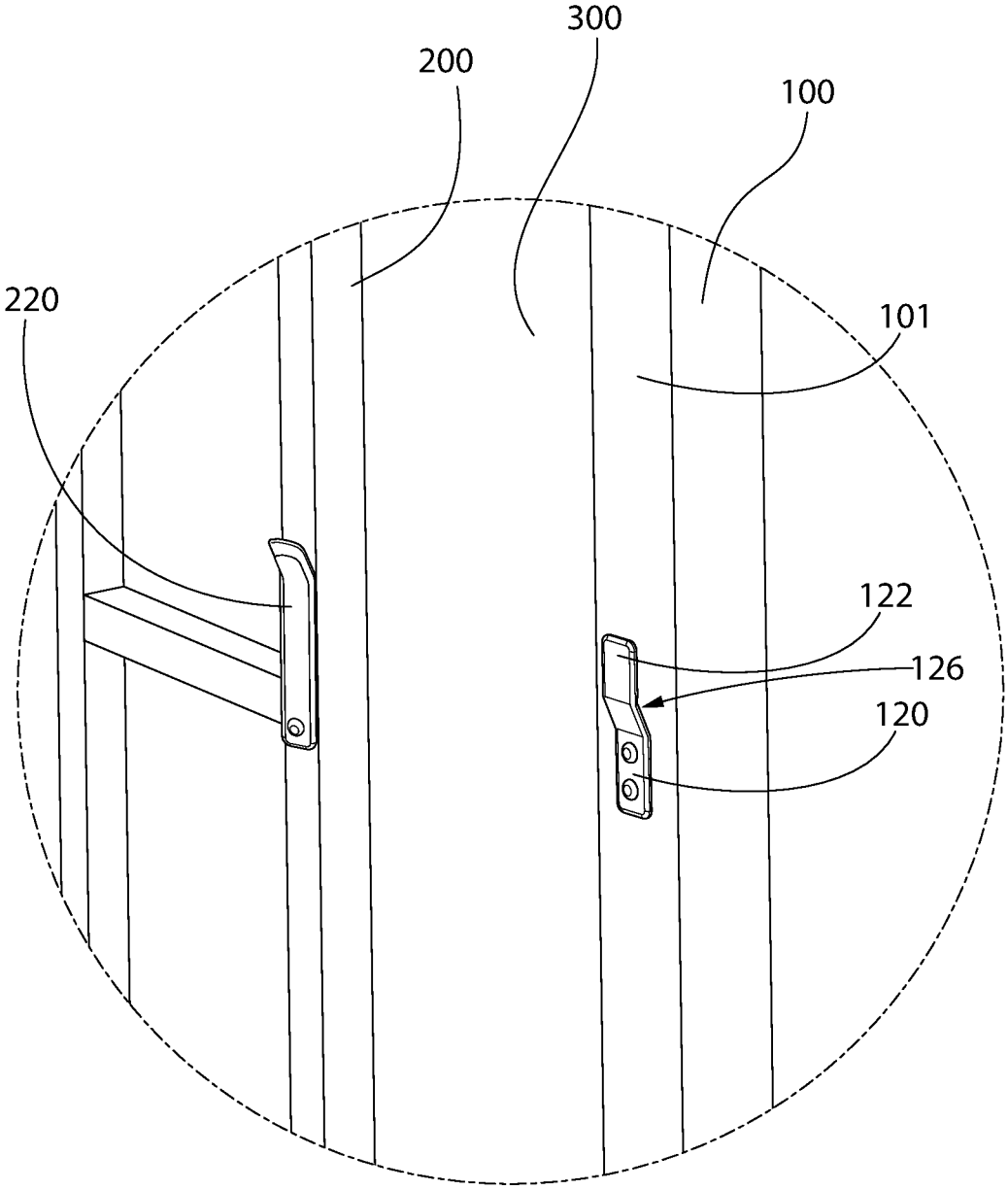
FIG. 5A is a close-up view of area VA of FIG. 5.

Next, referring to FIGS. 5 and 5A, the decorative door 200 is illustrated in a partially open state. With the latch 220 having been removed from the gap 126, the decorative door 200 can be easily and readily rotated relative to the frame 100 and mirror 300 via the hinges 50. Specifically, the locking assembly 10 will not impede the opening of the decorative door 200 so long as the latch 220 is not located within the gap 126 between the locking portion 122 of the lock plate 120 and the front surface 101 of the frame 100.

FIG. 6 illustrates the decorative door 200 in an open state. The decorative door 200 can continue to be opened (beyond the position shown in FIG. 6) until it is parallel with the frame 100 to expose the entirety of the reflective front surface 301 of the mirror 300. As a result, the mirror 300 can be easily cleaned when the decorative door 200 is in the fully open state. This may be desirable because with the decorative door 200 in the closed or partially closed state, cleaning of the mirror 300 may be difficult due to the fretwork of the decorative door 200 overlying the mirrored surface. Thus, the feature that facilitates opening of the decorative door 200 enables the mirror 300 to be cleaned more easily. Opening and closing the decorative door 200 may also be desirable to change the room aesthetic.

Figure 7:
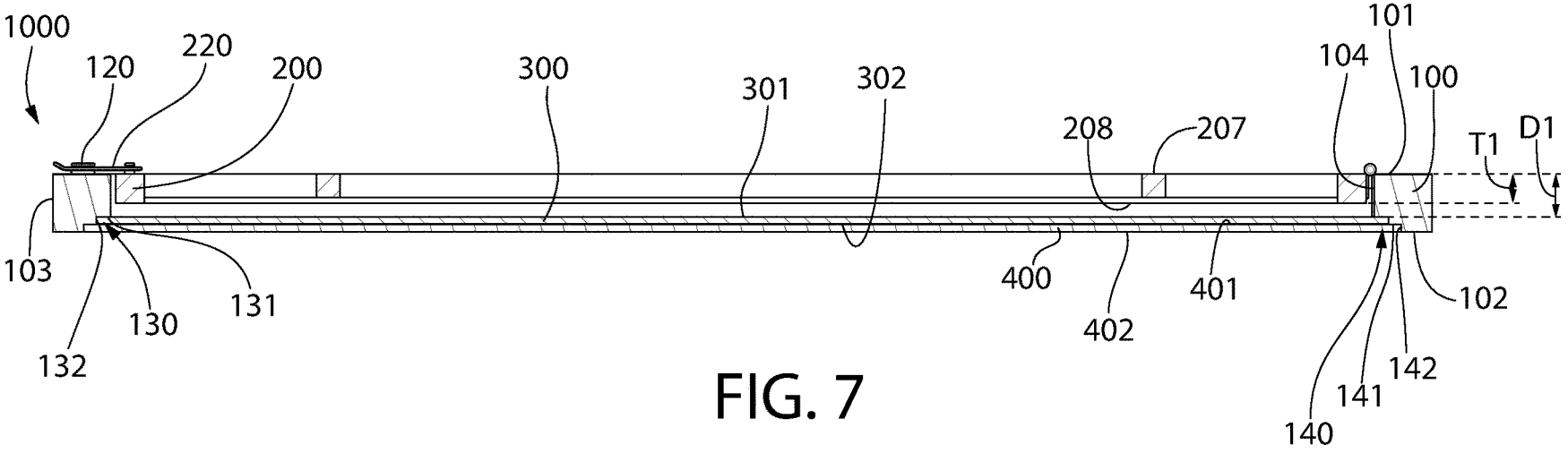
FIG. 7 is a cross-sectional view taken along line VII of FIG. 1.
Figure 8:
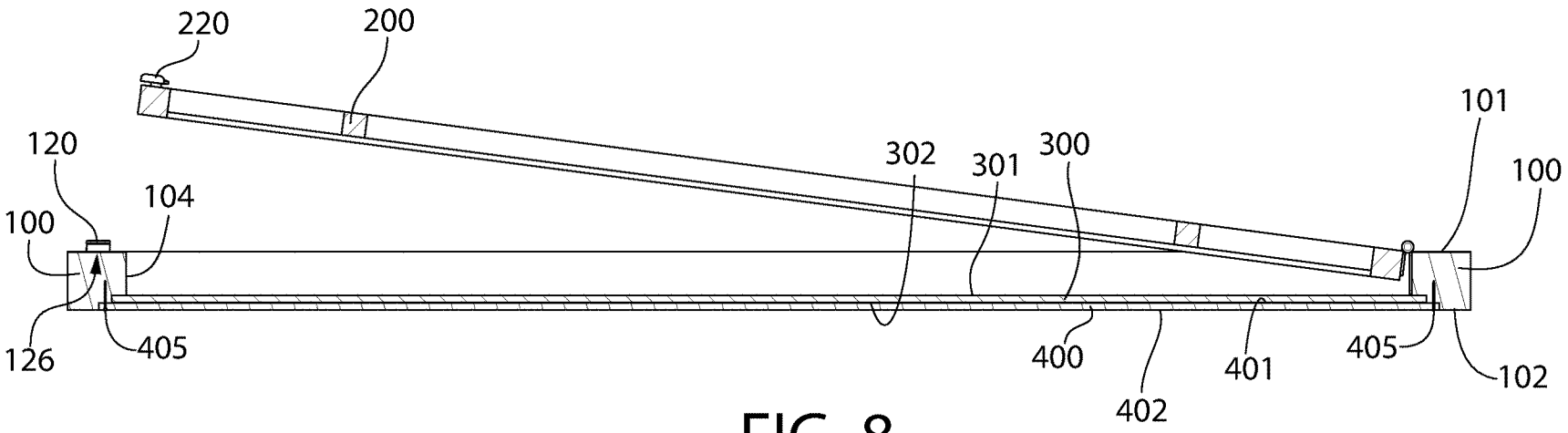
FIG. 8 is a cross-sectional view taken along line VIII of FIG. 5.

FIGS. 7 and 8 illustrate cross-sectional views of the mirror apparatus 1000, with FIG. 7 illustrating the decorative door 200 in the closed state and FIG. 8 illustrating the decorative door 200 in the partially open state. The frame 100 comprises a first rabbet 130 defined by a first floor 131 and a first sidewall 132 and a second rabbet 140 defined by a second floor 141 and a second sidewall 142. The second rabbet 140 is located adjacent to the rear surface 102 of the frame 100 and the first rabbet 131 is located between the second rabbet 140 and the front surface 101 of the frame 100. Specifically, the first floor 131 extends from the inner surface 104 of the frame 100 to the first sidewall 132 and the second sidewall 142 extends from the rear surface 102 of the frame 100 to the second floor 141. The first sidewall 132 extends from the first floor 131 to the second floor 141. The second floor 141 is located closer to the rear surface 102 of the frame 100 than the first floor 131 and the second sidewall 142 is located closer to the outer surface 103 of the frame 100 than the first sidewall 132.

To assemble the mirror apparatus 1000, first the mirror 300 is placed within the first rabbet 130 of the frame 100. The mirror 300 may be coupled to the frame 100 within the first rabbet 130 by using an adhesive, glue, tape, fasteners, or the like, although this is not required in all embodiments and in other embodiments the mirror 300 may simply be placed within the first rabbet 130 but not secured thereto with any external components.

Next, the backer panel 400 is placed within the second rabbet 140. The backer panel 400 may be coupled to the frame 100 using an adhesive, glue, tape, fasteners, nails, screws, or the like. In the exemplified embodiment, the backer panel 400 is coupled to the frame 100 using fasteners 405 that extend through the backer panel 400 and into the frame 100 without penetrating or passing through the mirror 300. In some embodiments, the mirror 130 may not be coupled to the frame 100 using adhesive or the like, but rather the coupling of the backer panel 400 to the frame 100 will hold the mirror 300 in place because it will be trapped between the backer panel 400 and the floor 131 of the first rabbet 130. As seen in FIGS. 7 and 8, in the exemplified embodiment the rear surface 402 of the backer panel 400 is flush with the rear surface 102 of the frame 100. Of course, the rear surface 402 of the backer panel 400 may stick out from or be recessed relative to the rear surface 102 of the frame 100 in other embodiments. Moreover, in the exemplified embodiment the front surface of the decorative door 200 is flush with the front surface 101 of the frame 100 (when the decorative door 200 is in the closed state as shown in FIG. 7).

As seen in FIG. 7, a distance D1 measured from the front surface 301 of the mirror 300 to the front surface 101 of the frame 100 is greater than a thickness T1 of the decorative door 200 measured from the front surface 207 of the decorative door 200 to the rear surface 208 of the decorative door 200. Thus, the rear surface 208 of the decorative door 200 is maintained spaced apart from the reflective front surface 301 of the mirror 300 when the decorative door 200 is in the closed state and the locking assembly 10 is in the locked state. This both protects the mirror 300 from being damaged by the decorative door 200 and enhances the aesthetic because it makes the fretwork design of the decorative door 200 visible as a reflection in the mirror 200 if the mirror apparatus 100 is viewed from any angle or orientation other than straight on.

Furthermore, as shown in FIGS. 7 and 8, the backer panel 400 is larger than the mirror 300 in every dimension. Specifically, the backer panel 400 and the mirror 300 have the same shape, except the backer panel 400 is slightly larger so that the perimeter region of the backer panel 400 extends beyond the outer edge of the mirror 300. This is what allows the backer panel 400 to sit within the second rabbet 140 while the mirror 300 sits within the first rabbet 130. This is also what allows the fasteners 405 to extend into and through the backer panel 400 and into the frame 100 without penetrating the mirror 300. In the exemplified embodiment, the backer panel 400 is slightly larger than the mirror 300 in every dimension The mirror apparatus 1000 may have a height measured from the bottom end 108 to the top end 109 of between 35 inches and 45 inches, and more specifically approximately 40 inches. The mirror apparatus 1000 may have a width of between 20 inches and 28 inches, and more specifically approximately 24 inches. Of course, other dimensions are possible in other embodiments. As discussed herein, the mirror apparatus 1000, and also the frame 100, the decorative door 200, the mirror 300, and the backer panel 400 thereof, have an arched shape with a curved arched top.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A mirror apparatus comprising:

a longitudinal axis;

a frame comprising a front surface, a rear surface, and an inner surface that defines a display opening;

a mirror coupled to the frame within the display opening, the mirror comprising a reflective front surface that is exposed within the display opening;

a decorative door pivotably coupled to the frame with one or more hinges located on a first side of the longitudinal axis, the decorative door being pivotable between: (1) a closed state whereby the decorative door overlies a portion of the reflective front surface of the mirror, the front surface of the frame remains uncovered by the decorative door, and the decorative door is located within the display opening defined by the inner surface of the frame with a rear surface of the decorative door spaced apart from the reflective front surface of the mirror and a front surface of the decorative door flush with the front surface of the frame, the decorative door comprising a plurality of openings through which the reflective front surface of the mirror is exposed; and (2) an open state whereby the decorative door does not overlie any portion of the reflective front surface of the mirror;

a locking assembly configured to lock the decorative door in the closed state, the locking assembly comprising a lock plate coupled to the front surface of the frame on a second side of the longitudinal axis and a latch pivotably coupled to the front surface of the decorative door;

the lock plate comprising a mounting portion coupled to the front surface of the frame and a locking portion that extends from the mounting portion and is spaced apart from the front surface of the frame by a gap;

wherein the locking assembly is adjustable between: (1) a locked state whereby the latch is located within the gap and the decorative door is locked in the closed state; and (2) an unlocked state whereby the latch is not located within the gap and the decorative door can be freely pivoted between the closed and open states; and wherein the lock plate is non-movably coupled to the front surface of the frame, and wherein the latch is configured for 360° rotation relative to the decorative door.

2. The mirror apparatus according to claim 1 wherein the decorative door is a singular monolithic structure comprising:

an arch-shaped perimeter portion having an outer surface that is adjacent to the inner surface of the frame when the decorative door is in the closed state and an inner surface opposite the outer surface; and an ornamental portion comprising a plurality of linear and arcuate strips that are located within an opening defined by the perimeter portion.

3. A mirror apparatus comprising:

a longitudinal axis;

a frame comprising a front surface, a rear surface, an inner surface that defines a display opening, and an outer surface opposite the inner surface;

a mirror coupled to the frame within the display opening, the mirror comprising a reflective front surface that is exposed within the display opening;

a decorative door pivotably coupled to the frame with one or more hinges located on a first side of the longitudinal axis, the decorative door being pivotable between: (1) a closed state whereby the decorative door overlies a portion of the reflective front surface of the mirror, the front surface of the frame remains uncovered by the decorative door, and the decorative door is located within the display opening defined by the inner surface of the frame with a rear surface of the decorative door spaced apart from the reflective front surface of the mirror and a front surface of the decorative door flush with the front surface of the frame, the decorative door comprising a plurality of openings through which the reflective front surface of the mirror is exposed; and (2) an open state whereby the decorative door does not overlie any portion of the reflective front surface of the mirror;

a locking assembly configured to lock the decorative door in the closed state, the locking assembly comprising a lock plate coupled to the front surface of the frame on a second side of the longitudinal axis and a latch pivotably coupled to the front surface of the decorative door;

a first rabbet formed into the rear surface of the frame and having a first floor and a first sidewall and a second rabbet formed into the rear surface of the frame and having a second floor and a second sidewall, the first floor being located further from the rear surface of the frame than the second floor and the first sidewall being located further from the outer surface of the frame than the second sidewall;

wherein a perimeter portion of the mirror is located within the first rabbet; and wherein a perimeter portion of a backer panel is positioned within the second rabbet.

4. The mirror apparatus according to claim 3 wherein the backer panel is coupled to the frame with fasteners that extend through the backer panel and into the frame without passing through the mirror, and wherein a rear surface of the backer panel is flush with the rear surface of the frame.

5. The mirror apparatus according to claim 3 further comprising a hanging element coupled to the rear surface of the frame, the hanging element comprising a plate portion that overlies the backer panel to retain the backer panel within the second rabbet.

6. The mirror apparatus according to claim 3 wherein the first floor of the first rabbet extends from the inner surface of the frame to the first sidewall of the first rabbet, and wherein the second sidewall of the second rabbet extends from the rear surface of the frame to the second floor of the second rabbet.

7. A mirror apparatus comprising:

a longitudinal axis;

a frame comprising a front surface, a rear surface, and an inner surface that defines a display opening;

a mirror coupled to the frame within the display opening, the mirror comprising a reflective front surface that is exposed within the display opening;

a decorative door pivotably coupled to the frame with one or more hinges located on a first side of the longitudinal axis, the decorative door being pivotable between: (1) a closed state whereby the decorative door overlies a portion of the reflective front surface of the mirror, the front surface of the frame remains uncovered by the decorative door, and the decorative door is located within the display opening defined by the inner surface of the frame with a rear surface of the decorative door spaced apart from the reflective front surface of the mirror and a front surface of the decorative door flush with the front surface of the frame, the decorative door comprising a plurality of openings through which the reflective front surface of the mirror is exposed; and (2) an open state whereby the decorative door does not overlie any portion of the reflective front surface of the mirror;

a locking assembly configured to lock the decorative door in the closed state, the locking assembly comprising a lock plate coupled to the front surface of the frame on a second side of the longitudinal axis and a latch pivotably coupled to the front surface of the decorative door; and wherein the decorative door is a singular monolithic structure having a perimeter portion that surrounds an entirety of an exposed portion of the reflective front surface of the mirror when the decorative door is in the closed state, and wherein an entirety of the decorative door is located within the display opening and between the front and rear surfaces of the frame when the decorative door is in the closed state such that a portion of the front surface of the frame which surrounds the mirror is exposed and not covered by the decorative door when the decorative door is in the closed state.

8. A mirror apparatus comprising:

a longitudinal axis;

a frame comprising a front surface, a rear surface, and an inner surface that defines a display opening;

a mirror coupled to the frame within the display opening, the mirror comprising a reflective front surface that is exposed within the display opening;

a decorative door pivotably coupled to the frame with one or more hinges located on a first side of the longitudinal axis, the decorative door being pivotable between: (1) a closed state whereby the decorative door overlies a portion of the reflective front surface of the mirror, the front surface of the frame remains uncovered by the decorative door, and the decorative door is located within the display opening defined by the inner surface of the frame with a rear surface of the decorative door spaced apart from the reflective front surface of the mirror and a front surface of the decorative door flush with the front surface of the frame, the decorative door comprising a plurality of openings through which the reflective front surface of the mirror is exposed; and (2) an open state whereby the decorative door does not overlie any portion of the reflective front surface of the mirror;

a locking assembly configured to lock the decorative door in the closed state, the locking assembly comprising a lock plate coupled to the front surface of the frame on a second side of the longitudinal axis and a latch pivotably coupled to the front surface of the decorative door; and wherein the decorative door comprises a perimeter portion and an ornamental portion that is surrounded by the perimeter portion, the perimeter portion forming a closed geometric shape and the ornamental portion comprising a plurality of strips located within the closed geometric shape of the perimeter portion to define a fretwork design.

9. The mirror apparatus according to claim 8 wherein the fretwork design forms the plurality of openings of the decorative door through which the reflective front surface of the mirror is exposed, and wherein one of the openings has an area of between 2.0 $ft^2$ and 2.5 $ft^2$.

10. The mirror apparatus according to claim 8 wherein the fretwork design comprises at least ten distinct openings.

11. The mirror apparatus according to claim 8 wherein an entirety of an outer surface of the perimeter portion of the decorative door faces the inner surface of the frame such that the closed geometric shape of the perimeter portion of the decorative door corresponds to a shape of the frame.

12. The mirror apparatus according to claim 8 wherein the plurality of strips of the ornamental portion of the decorative door comprises at least one horizontal strip that the latch of the locking assembly is coupled to such that when the decorative door is in the closed state and the locking assembly is in a locked state a transverse axis that is transverse to a longitudinal axis of the mirror apparatus intersects the at least one horizontal strip and the latch.

13. A mirror apparatus comprising:

a longitudinal axis;

a frame comprising a front surface, a rear surface, and an inner surface that defines a display opening;

a mirror coupled to the frame within the display opening, the mirror comprising a reflective front surface that is exposed within the display opening;

a decorative door pivotably coupled to the frame with one or more hinges located on a first side of the longitudinal axis, the decorative door being pivotable between: (1) a closed state whereby the decorative door overlies a portion of the reflective front surface of the mirror, the front surface of the frame remains uncovered by the decorative door, and the decorative door is located within the display opening defined by the inner surface of the frame with a rear surface of the decorative door spaced apart from the reflective front surface of the mirror and a front surface of the decorative door flush with the front surface of the frame, the decorative door comprising a plurality of openings through which the reflective front surface of the mirror is exposed; and (2) an open state whereby the decorative door does not overlie any portion of the reflective front surface of the mirror;

a locking assembly configured to lock the decorative door in the closed state, the locking assembly comprising a lock plate coupled to the front surface of the frame on a second side of the longitudinal axis and a latch pivotably coupled to the front surface of the decorative door; and wherein the frame is formed of natural or engineered wood and the decorative door is formed entirely of metal.

14. A mirror apparatus comprising:

a longitudinal axis;

a frame comprising a front surface, a rear surface, and an inner surface that defines a display opening;

a mirror coupled to the frame within the display opening, the mirror comprising a reflective front surface that is exposed within the display opening;

a decorative door pivotably coupled to the frame with one or more hinges located on a first side of the longitudinal axis, the decorative door being pivotable between: (1) a closed state whereby the decorative door overlies a portion of the reflective front surface of the mirror, the front surface of the frame remains uncovered by the decorative door, and the decorative door is located within the display opening defined by the inner surface of the frame with a rear surface of the decorative door spaced apart from the reflective front surface of the mirror and a front surface of the decorative door flush with the front surface of the frame, the decorative door comprising a plurality of openings through which the reflective front surface of the mirror is exposed; and (2) an open state whereby the decorative door does not overlie any portion of the reflective front surface of the mirror;

a locking assembly configured to lock the decorative door in the closed state, the locking assembly comprising a lock plate coupled to the front surface of the frame on a second side of the longitudinal axis and a latch pivotably coupled to the front surface of the decorative door; and wherein the decorative door is located within the display opening and between the front and rear surfaces of the frame such that the decorative door does not protrude beyond the front and rear surfaces of the frame when the decorative door is in the closed state.

15. A mirror apparatus comprising:

a frame formed from wood and comprising a longitudinal axis, an inner surface that defines a display opening, a front surface, and a rear surface opposite the front surface;

a first rabbet and a second rabbet formed into the rear surface of the frame;

a mirror coupled to the frame within the first rabbet, the mirror comprising a reflective front surface that is exposed within the display opening;

a backer panel coupled to the frame within the second rabbet;

a first hanging element coupled to the rear surface of the frame on a first side of the longitudinal axis and a second hanging element coupled to the rear surface of the frame on a second side of the longitudinal axis, each of the first and second hanging elements comprising a plate portion that overlies the backer panel;

a set of hinges coupled to the inner surface of the frame on the first side of the longitudinal axis;

a decorative door formed from metal and pivotably coupled to the frame via the set of hinges, the decorative door being pivotable between: (1) a closed state whereby the decorative door is located within the display opening and overlies a portion of the reflective front surface of the mirror without overlying the front surface of the frame, the decorative door comprising a plurality of openings through which the reflective front surface of the mirror remains exposed; and (2) an open state whereby the decorative door does not overlie any portion of the reflective front surface of the mirror; and a locking assembly comprising:

a lock plate coupled to the front surface of the frame on the second side of the longitudinal axis; and a latch pivotably coupled to a front surface of the decorative door; and wherein the locking assembly is adjustable between: (1) a locked state whereby the latch is oriented transverse to the longitudinal axis and the latch is located between the front surface of the frame and a portion of the lock plate to lock the decorative door in the closed state; and (2) an unlocked state whereby the latch is oriented parallel to the longitudinal axis and the decorative door can be freely pivoted between the closed and open states; and wherein the decorative door is a singular monolithic structure that is pivotably coupled to the frame along a singular pivot axis, the singular monolithic structure configured to be locked directly to the frame via the locking assembly when in the closed state.

16. The mirror apparatus according to claim 15 wherein the decorative door comprises a perimeter portion and an ornamental portion that is surrounded by the perimeter portion, the perimeter portion forming a closed geometric shape that matches a shape of the frame and the ornamental portion comprising a plurality of strips located within the closed geometric shape of the perimeter portion to define a fretwork design, wherein the fretwork design forms the plurality of openings of the decorative door through which the reflective front surface of the mirror is exposed, and wherein one of the openings has an area of between 2.0 $ft^2$ and 2.5 $ft^2$, and wherein a ratio of the area of the one of the openings to an area of each remaining opening of the plurality of openings is between 4:1 and 10:1.

17. The mirror apparatus according to claim 16 wherein when the decorative door is in the closed state an entirety of the decorative door is located within the display opening defined by the inner surface of the frame such that no part of the decorative door protrudes beyond the front and rear surfaces of the frame.

18. The mirror apparatus according to claim 17 wherein when the decorative door is in the closed state and the locking assembly is in the locked state a rear surface of the decorative door is spaced apart from the reflective front surface of the mirror and a front surface of the decorative door is flush with the front surface of the frame.

* * * * *